US005951245A

United States Patent [19]

Sullivan

[11] Patent Number: 5,951,245

[45] Date of Patent: Sep. 14, 1999

[54] CENTRIFUGAL FAN ASSEMBLY FOR AN AUTOMOTIVE VEHICLE

[75] Inventor: Timothy James Sullivan, Canton, Mich.

[73] Assignee: Ford Motor Company, Dearborn, Mich.

[21] Appl. No.: 08/944,503

[22] Filed: Oct. 6, 1997

[51] Int. Cl.[6] ..... F01D 1/02

[52] U.S. Cl. ..... 415/192; 415/121.2; 415/208.2; 415/210.1

[58] Field of Search ..... 415/191, 192, 415/121.2, 206, 208.2, 210.1, 208.1; 416/247 R

[56] References Cited

U.S. PATENT DOCUMENTS

| | | | |
|---|---|---|---|
| 654,654 | 7/1900 | Lawrence | 415/68 |
| 2,570,155 | 10/1951 | Redding | 415/192 |
| 2,727,680 | 12/1955 | Madison et al. | 415/191 |
| 2,834,536 | 5/1958 | McDonald | 415/159 |
| 3,096,080 | 7/1963 | Willems . | |
| 3,178,099 | 4/1965 | Child | 415/208.1 |
| 3,583,827 | 6/1971 | Wood . | |
| 3,781,127 | 12/1973 | Wood | 415/160 |
| 3,782,851 | 1/1974 | Hackbarth et al. | 415/915 |
| 4,021,135 | 5/1977 | Pedersen et al. | 415/208.2 |
| 4,177,007 | 12/1979 | Schlangen et al. . | |
| 4,208,167 | 6/1980 | Yasugahira et al. | 415/191 |
| 4,566,852 | 1/1986 | Hauser | 415/220 |
| 4,917,572 | 4/1990 | Van Houten | 415/121.2 |
| 4,946,348 | 8/1990 | Yapp | 415/211.2 |
| 5,183,382 | 2/1993 | Carroll . | |
| 5,215,437 | 6/1993 | TeVelde et al. | 415/223 |
| 5,466,120 | 11/1995 | Takeuchi et al. | 415/191 |
| 5,474,422 | 12/1995 | Sullivan | 415/206 |

FOREIGN PATENT DOCUMENTS

| | | |
|---|---|---|
| 192760 | 2/1923 | United Kingdom . |
| 1502781 | 3/1978 | United Kingdom . |

*Primary Examiner*—Edward K. Look
*Assistant Examiner*—Richard Woo
*Attorney, Agent, or Firm*—Raymond L. Coppiellie

[57] ABSTRACT

A centrifugal blower assembly is disclosed. The blower assembly includes a centrifugal fan driven by an electric motor and a stationary device which imparts a predetermined amount of spin to a volume of air as the air enters the centrifugal blower assembly. The device is disposed axially with respect to the axis of rotation of the fan and is secured thereto so as not to include any moving parts.

17 Claims, 4 Drawing Sheets

CENTRIFUGAL FAN ASSEMBLY FOR AN AUTOMOTIVE VEHICLE

BACKGROUND OF THE INVENTION

1. Field of the Invention

The present invention relates generally to centrifugal fans for automotive vehicles. More particularly, the present invention relates to an apparatus for rotating a volume of air entering the centrifugal blower assembly.

2. Background Information

Centrifugal blowers and fans generally include an impeller that rotates in a predetermined direction in a housing and which may be driven by an electric motor. The impeller has curved blades which draw air in axially, along the impellers' axis of rotation, and discharge air radially outwardly. Such blowers are used in a variety of applications, such as in automotive applications.

Centrifugal fans have been fitted with well known shutter devices to reduce the opening of the air passage formed through the fan casing to control the capacity of the fan. The shutter arrangement can be closed to provide adequate airflow adjustment while, at the same time, reducing the horsepower requirements of the fan. However, with these type of shutter arrangements, fan pulsations can occur when the air passage opening is partially closed. In those cases where the shutters are opened fully, the incoming air impinging on the impeller blades often results in a substantial amount of boundary layer flow separation due to the angle with which the incoming air contacts the leading edge of the impeller blades. This separation can result in increasing noise, vibration, and harshness as well as degrading the efficiency of the centrifugal blower.

To overcome the above-described problems, U.S. Pat. No. 3,781,127 discloses a centrifugal blower which includes a plurality of spin inducing inlet vanes and a mechanism for pivotably supporting the vanes around the outer wall of the inlet to the centrifugal blower. With this arrangement, the capacity or amount of air entering the blower can be controlled and a spin can be imparted to the incoming gas. Alternatively, the vanes can be shut completely, restricting the flow of gas into the blower while imparting a maximum spin to the incoming gas. The system of the '127 patent is attached to a position outside of the housing of the blower.

Each vane of the assembly '127 can pivot to vary the amount of opening to the air entering the fan blower. However, the assembly is costly and complex to manufacture. Furthermore, the assembly needs a mechanism to control the amount of rotation or pivot of each of the blades relative to the blower housing, adding further cost and complexity to the centrifugal blower. Also, the amount of spin imparted by the moveable blades is insufficient to overcome or reduce the boundary layer flow separation around each of the blades of the centrifugal blower. Therefore, it would be advantageous to provide a less expensive and complicated device which reduces the flow separation around each of the blades of the centrifugal blower impeller and improves the efficiency of the blower.

SUMMARY OF THE INVENTION

The problems associated with the prior art are overcome by the present invention which provides an apparatus for imparting a rotation to a volume of air entering a centrifugal blower. The apparatus comprises a hub and a first annular ring disposed around the hub and which defines a first annular region therebetween. The apparatus also includes a plurality of stationary blades disposed in the first annular region generally perpendicular to the axis of rotation of the centrifugal blower. Each blade includes a leading edge and a trailing edge and defines a transition portion between the leading and trailing edges. Each of the blades is further configured to cause a volume of air to rotate a predetermined amount after the volume of air passes through the blades.

In one embodiment, the apparatus includes a plurality of annular regions, each of the annular regions having a plurality of blades therein. For example, one embodiment includes a first and second annular regions defined by a first and second annular rings. A plurality of blades is disposed in each of the annular regions, and the blades in each region have a different profile so as to impart a different amount of rotation to the volume of air passing through them. Another embodiment of the present invention includes a third annular region having a third set of blades therein which imparts a different amount of rotation to the volume of air passing through the blades. Each embodiment of the present invention can be manufactured by an injection molding process which decreases the cost and complexity of the apparatus as compared to prior art devices.

The present invention provides the advantage that a stationary, moldable device can impart a spin to a volume of air entering a centrifugal blower, causing the air to impinge upon the blades of the blower wheel in such a way to reduce or eliminate boundary layer flow separation as the air passes over the blades. This increases the efficiency of the centrifugal blower while reducing cost and noise vibration and harshness. These and other advantages of the present invention will become apparent from the drawings, detailed description and claims which follow.

DETAILED DESCRIPTION OF THE PREFERRED EMBODIMENTS

Figure 1:
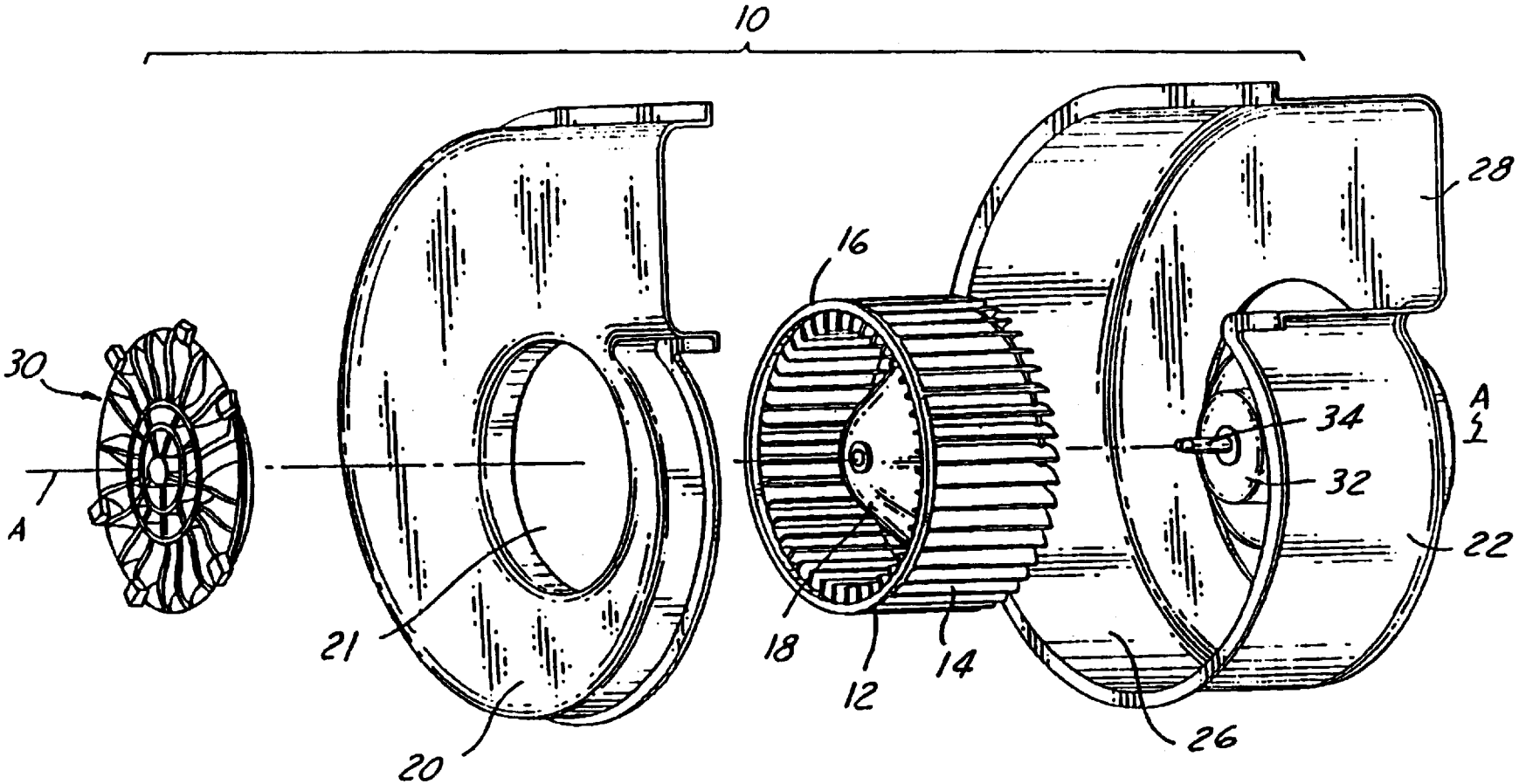
FIG. 1 is an exploded, perspective view of a centrifugal blower/fan assembly structured in accord with the principles of the present invention.

Referring now to the drawings, FIG. 1 shows a centrifugal blower/fan assembly according to the present invention. The centrifugal blower assembly 10 includes a fan wheel 12 having a plurality of fan blades 14 disposed around an inlet ring 16 and a hub 18 of the fan wheel. The fan wheel 12 is disposed within a housing 18 defined by two cover pieces, a left or inlet housing cover 20 and a right or exit housing cover 22. The inlet housing cover 20 includes an inlet aperture 21 through which a volume of air is drawn by the fan wheel 12 to provide a volume of air through different heating, ventilation, and air conditioning components found within a plenum of an automotive vehicle. The right and left housing covers 20, 22 cooperate to define an airflow passage volume 26 therebetween as well as an exit end 28 through which the air passes into or toward the heating, ventilation, and air conditioning components in the plenum. The centrifugal blower assembly 10 of the present invention further includes a pre-swirler 30 which fits over the inlet aperture of the inlet housing 20 to impart a spin or rotation onto a volume of air entering into the centrifugal blower assembly 10. The pre-swirler 30 will be described in much greater detail below. The centrifugal blower assembly further includes a motor 32 having a shaft 34 which engages the centrifugal fan 12 to cause the fan to spin, thus drawing air in through the inlet end of the housing around the airflow passage 26 and through the outlet end 28 of the centrifugal blower assembly.

Figure 2:
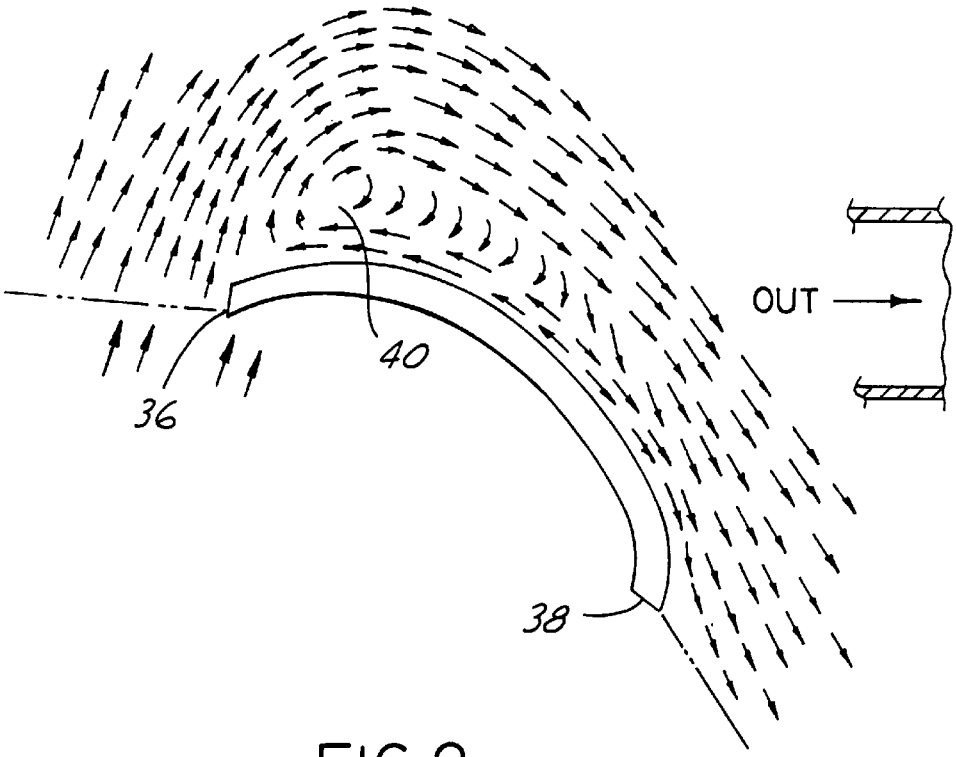
FIG. 2 is a velocity vector diagram for a centrifugal fan blade in a centrifugal blower assembly without an apparatus according to the present invention.
Figure 3:
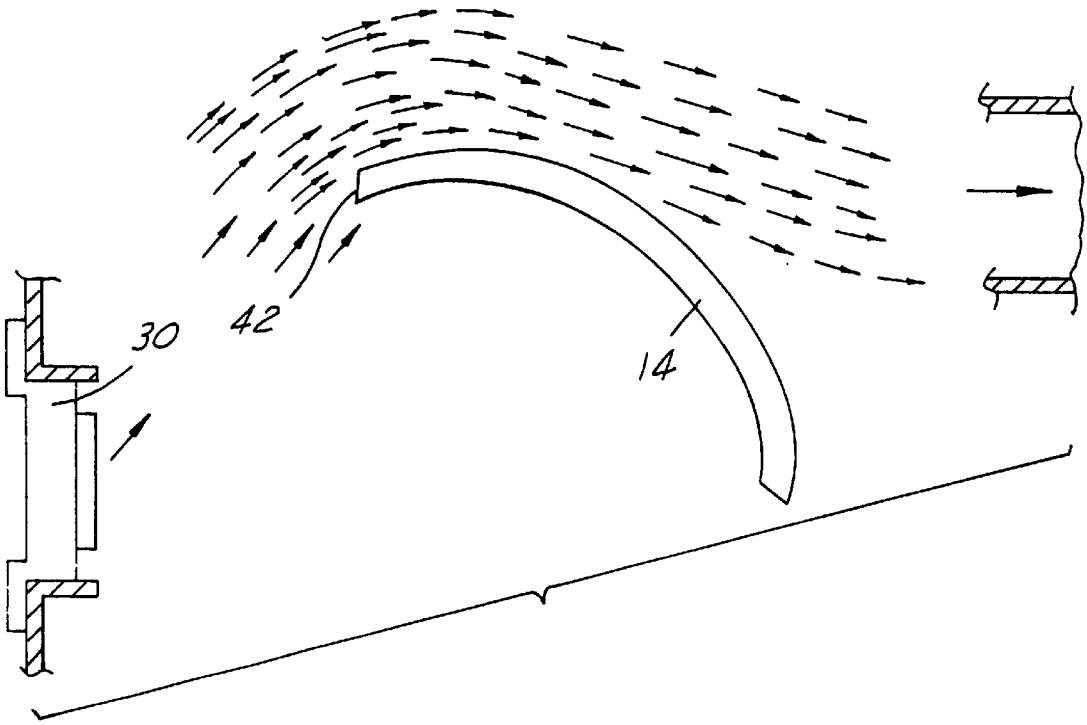
FIG. 3 is a velocity vector diagram for a centrifugal fan blade in a centrifugal blower structured in accord with the principles of the present invention.

FIGS. 2 and 3 show the effect that the pre-swirler 30 of the present invention has on the airflow entering the centrifugal blower assembly 10. FIG. 2 is a velocity vector diagram of a typical centrifugal blower assembly without an apparatus for imparting a rotation or a spin onto a volume of air prior to the air entering the centrifugal fan. In FIG. 2 the fan blade 14 of the centrifugal fan 12 is shown in profile. The blade 14 includes a leading edge 36 and a trailing edge 38. The arrows in the diagram represent the airflow and as shown, the airflow strikes the leading edge of the blade 14 at an almost perpendicular angle. By striking the blade at that angle, a boundary layer airflow separation area 40 occurs. This area 40 of airflow separation causes an inefficiency of the centrifugal fan and can cause noise, vibration or harshness within the centrifugal blower assembly. By contrast, FIG. 3 shows the velocity vector diagram for a volume of air striking a blade of the centrifugal fan 12 after the volume of air has been rotated through a pre-swirler 30 according to the present invention. As shown in FIG. 3, the volume of air strikes the leading edge 42 of the blade 14 at a much smaller angle than that of the embodiment shown in FIG. 2. By striking the blade 14 at this angle, the area of airflow separation will be minimized or nonexistent. This increases the overall efficiency of the centrifugal fan 12 and blower assembly 10, resulting in less power needed to drive the fan for an equivalent amount of air to flow through assembly 10. Furthermore, since the airflow separation area is not formed, noise, vibration and harshness are less likely to develop within the assembly.

Figure 4:
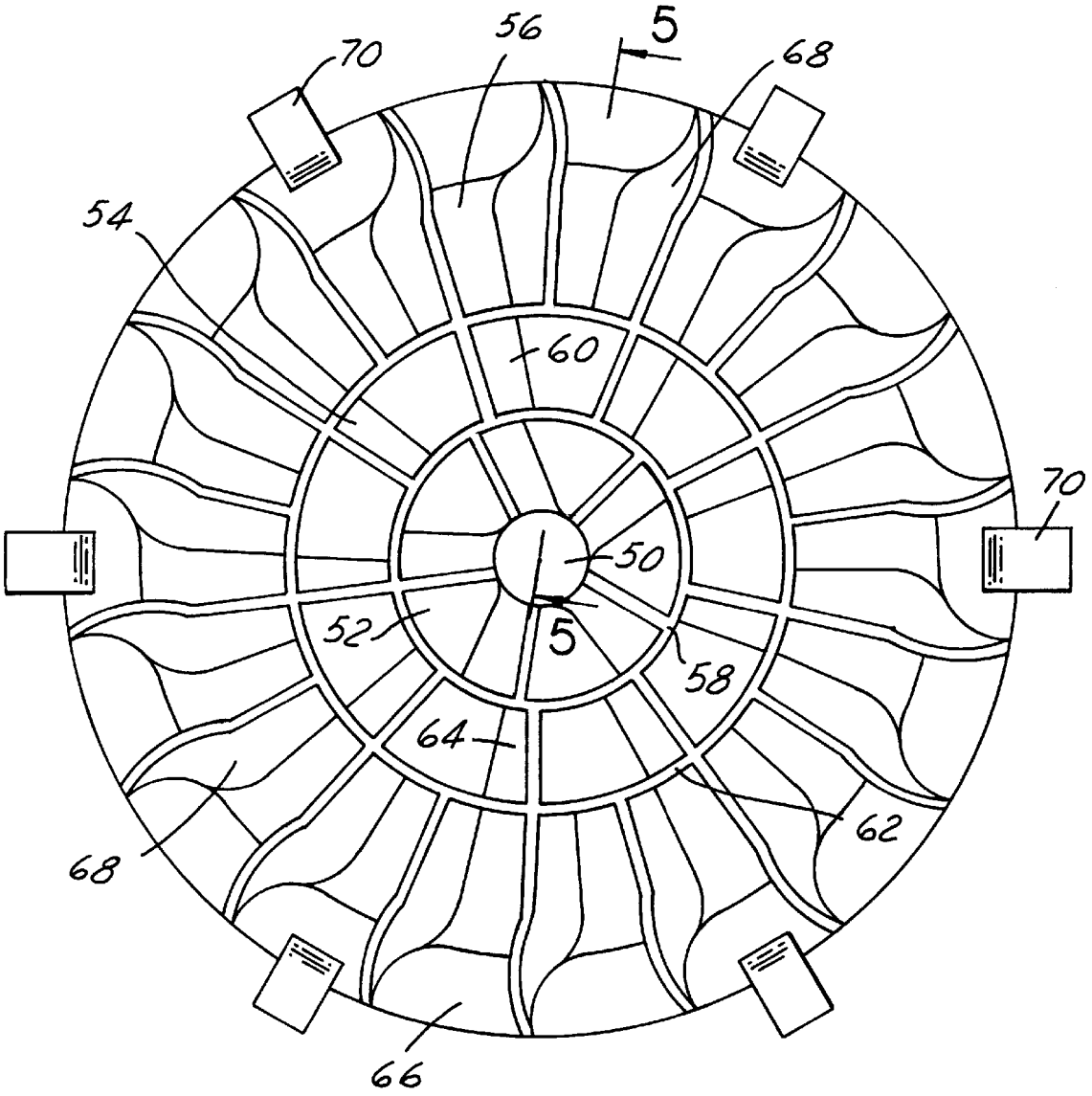
FIG. 4 is a top plan view of an apparatus structured in accord with the principles of the present invention for rotating a volume of air entering a centrifugal blower assembly.

Referring now to FIG. 4, the pre-swirler 30 of the present invention will be described. The pre-swirler 30 is stationary in that the pre-swirler does not rotate relative to the inlet end of the inlet housing cover 20 of the centrifugal blower assembly. Furthermore, none of the blades in the pre-swirler 30 move either; they are stationary as well. By fabricating the pre-swirler 30 to be stationary, the complexity of the mechanism is greatly reduced since the components necessary to move moveable vanes and the strategy for moving such vanes are not needed by a centrifugal blower of the present invention as is required in the prior art device such as disclosed in U.S. Pat. No. 3,781,127. The pre-swirler 30 is a generally circular member having a central hub 50 and a plurality of annular regions 52, 54, 56. The first annular region 52 is defined between the hub 50 and first annular ring 58. In the preferred embodiment, the first region 52 includes five blades 60, each of the blades having an airfoil shape which turns air as the air passes over the blades 60. The blades 60 in the first region 52 rotate the air passing over them approximately 65° relative to the plane of the pre-swirler 30.

The second annular region 54 is defined as that area between a second annular ring 62 and the first annular ring 58. The second annular region 54 includes a plurality of blades 64 which, as in the first region, cause the air passing through them to rotate prior to impinging upon the blades 14 of the centrifugal fan 12. The blades 64 in the second annular region 54 have an airfoil shape and are configured to rotate a volume of air passing over them at an angle of approximately 55° to the plane of the pre-swirler 30. The blades 64 in the second region have a different trailing edge profile than the blades 60 in the first annular region as will be shown later with reference to FIGS. 5 and 7.

The third annular region 56 is defined as the area between the second annular ring 62 and a third annular ring 66 disposed around the periphery of the pre-swirler 30. The third annular region 56 includes a plurality of blades 68, each of the blades 68 having a different trailing edge profile than the blades in either of the first 52 or second 54 annular regions. In the preferred embodiment, the third annular region 56 includes eighteen blades 68 as opposed to nine blades 24 in the second annular region and five blades 60 in the first annular region. The trailing edge profile of the blades 68 in the third annular region are configured to rotate the air passing over them approximately 45° to the plane of the pre-swirler 30. The third annular ring 66 also includes a plurality of tabs 70 which secure the pre-swirler 30 to the inlet cover housing 20 of the centrifugal blower assembly 10. The tabs 70 can be secured to the housing 20 by fasteners or adhesive or other known joining techniques. Alternatively, the pres-swirler 30 can be integrally molded with the inlet housing cover 20.

The number of blades chosen for each of the first, second and third regions described above was based upon the blade profile and configuration to optimize solidity and yield maximum pre-swirl while maintaining minimum air flow loss. The amount of rotation generated by each of the blades in the different regions were chosen to allow for free-vortex swirling flow. When taken together, the plurality of blades in the entire pre-swirler 30 cooperate to spin or rotate a volume of air 45° to the leading edge of the fan blades 14 in the fan wheel 12 of the assembly 10. By rotating the volume of air by 45°, the air impinges the leading edge of the blades such that a boundary layer separation area will be minimized or not occur.

Figure 5:
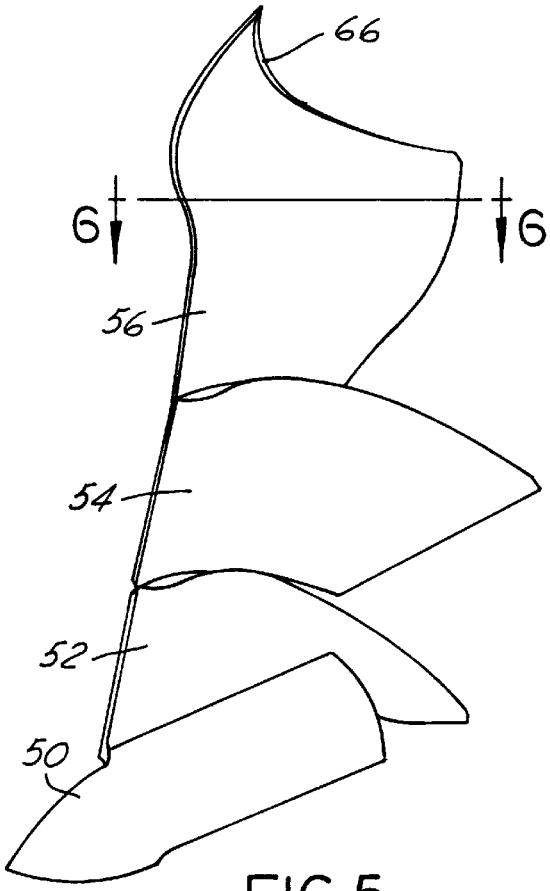
FIGS. 5, 6 and 7 are cross-sectional views taken along lines 5—5, 6—6 and 7—7, respectively, in FIGS. 4 and 5.
Figure 7:
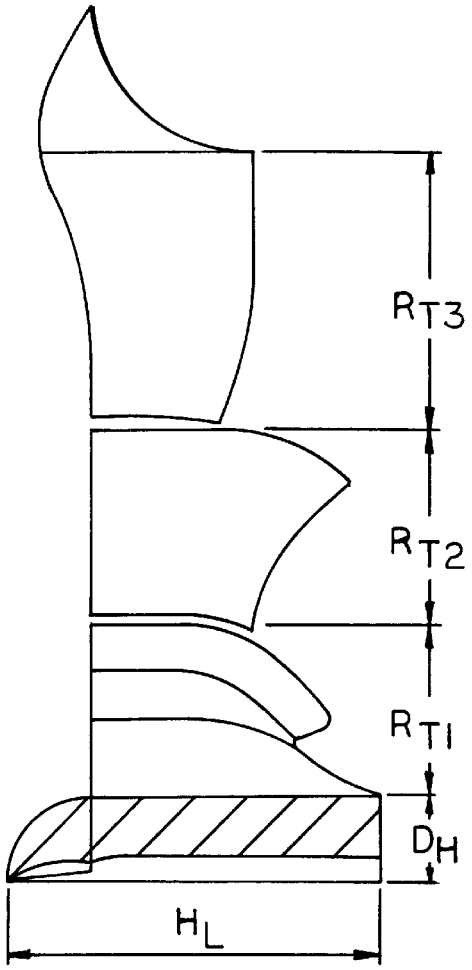
Figure 6:
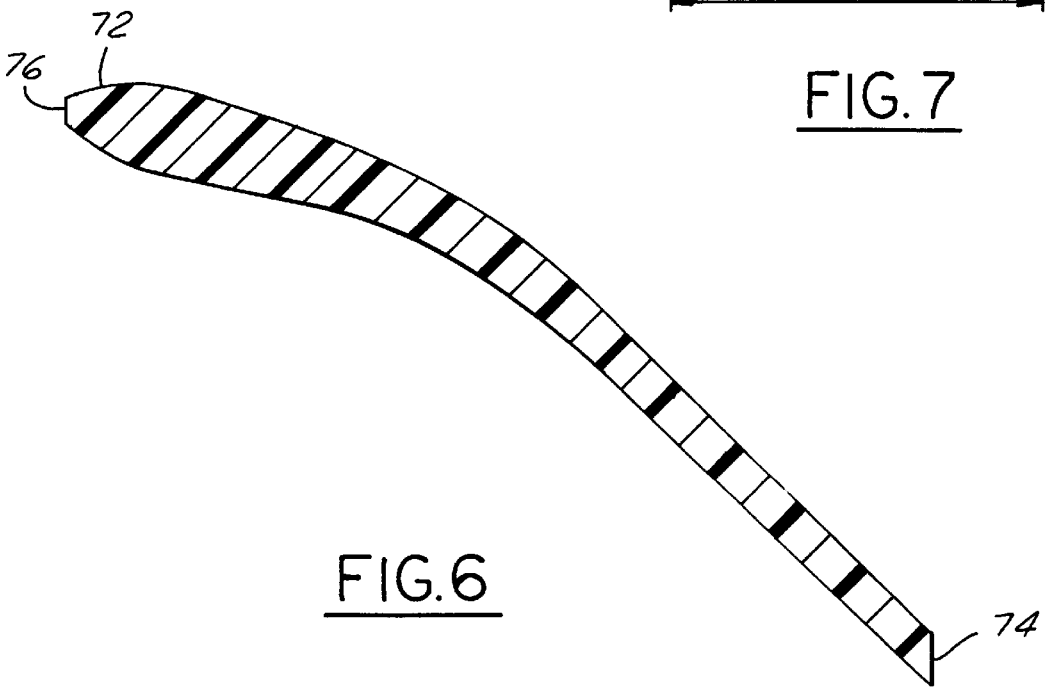

FIGS. 5–7 illustrate the specific differences between each of the blades in each annular region. Each of the blades of the pre-swirler 30 of the present invention has an airfoil shape including a leading edge 72, a trailing edge 74, and a transition region 76 therebetween. The maximum thickness of each of the blades in any of the regions is approximately 2.0 mm at the leading edge 72, decreasing to 1.2 mm at the trailing edge of the blades. The blades in each of the annular regions have different radial length as indicated in FIG. 7 ($R_T$). The radial length of the blades in the first region 52 $R_T$, ranges from approximately 12 to 20 mm, the radial length of the blades in the second annular region 54, $R_{T2}$, are approximately 14 to 22 mm while the radial length of the blades in the third annular region 56 $R_{T3}$, range from approximately 23 to 30 mm. The hub has a diameter, $D_H$, of approximately 16 mm and an overall length, $H_L$, of approximately 33 to 37 mm. Furthermore, each of the annular rings in the first and second annular regions has a thickness of approximately 1 mm while the third annular ring is approximately 16 to 18 mm wide.

The pre-swirler of the present invention can be injection molded from a variety of synthetic polymeric materials such as polypropylene, nylon, polyethylene and others known to those in the art.

Other modifications and permutations of the present invention will, no doubt, occur to those skilled in the art. For example, the number of blades each region of the pre-swirler can be altered depending upon the amount of rotation to be achieved by the pre-swirler. However, it is a critical aspect of the invention that the number of blades in preferred embodiment has been chosen to make the pre-swirler an injection moldable component, thereby reducing the cost of manufacturing such component. It is the following claims, including all equivalent, which define the scope of my invention.

What is claimed is:

1. An apparatus for imparting a rotation to a volume of air entering a centrifugal blower rotatable about an axis of rotation, comprising:

a hub;

a first annular ring having a predetermined diameter disposed around said hub and which defines a first annular region between said hub and said first annular ring;

a plurality of stationary blades disposed in said first annular region generally perpendicular to the axis of rotation of the centrifugal blower, said plurality of blades each having a leading edge and a trailing edge and defining a transition portion therebetween, each of the blades being configured to cause a volume of air to rotate a predetermined amount after said volume of air passes through said plurality of blades; and a second annular ring disposed around said hub having a diameter greater than the diameter of the first annular ring and defining a second annular region having a plurality of blades disposed therein generally perpendicular to the axis of rotation of the centrifugal blower, each of the blades in said second annular region having a different trailing edge profile than the blades in said first annular region.

2. An apparatus according to claim 1, wherein each blade of said plurality of blades includes an airfoil shape configured to turn a volume of air in a predetermined manner.

3. An apparatus according to claim 1, wherein the number of blades disposed in said second annular region is different than the number of blades in said first annular region.

4. An apparatus according to claim 3, wherein said second annular region includes 9 blades.

5. An apparatus according to claim 1, wherein each of the blades in said first and second annular regions have a predetermined radial length, the radial length of the blades in said second annular region being greater than the radial length of the blades in said first annular region.

6. An apparatus according to claim 1, wherein the blades of the first annular region are configured so that a volume of air passes therethrough at an angle different than a volume of air passing through the blades in said second annular region.

7. An apparatus according to claim 1, further including a third annular ring disposed around said hub, the diameter of said third annular ring being greater than the diameter of the second annular ring.

8. An apparatus according to claim 7, wherein said third annular ring defines a third annular region having a plurality of blades disposed therein generally perpendicular to the axis of rotation of the centrifugal blower.

9. An apparatus according to claim 8, wherein the number of blades disposed in said third annular region is different than the number of blades in said second annular region.

10. An apparatus according to claim 9, wherein said third annular region includes 18 blades.

11. An apparatus according to claim 8, wherein each of the blades in said third annular region has a different trailing edge profile than the blades in said second annular region.

12. An apparatus according to claim 11, wherein each of the blades in said second and third annular regions have a predetermined radial length, the radial length of the blades in said third annular region being greater than the radial length of the blades in said second annular region.

13. An apparatus according to claim 8, wherein the blades in each of the annular regions are configured so that a volume of air passes therethrough at different angles.

14. An apparatus according to claim 13, wherein said apparatus is injection molded from a synthetic polymeric material.

15. An apparatus for imparting a rotation to a volume of air entering a centrifugal blower rotatable about an axis of rotation, comprising:

a hub;

a first annular ring having a predetermined diameter disposed around said hub and which defines a first annular region between said hub and said first annular ring;

a second annular ring disposed around said hub having a diameter greater than the diameter of the first annular ring;

a third annular ring disposed around said hub having a diameter greater than the diameter of the second annular ring;

each of said annular regions including a plurality of stationary, airfoil-shaped blades disposed generally perpendicular to the axis of rotation of the centrifugal blower, said plurality of blades each having a leading edge and a trailing edge and defining a transition portion therebetween, each of the blades in said first, second and third annular regions has a different trailing edge profile, and each of the blades being configured to cause a volume of air to rotate a predetermined amount after said volume of air passes through said plurality of blades.

16. An apparatus according to claim 15, wherein the number of blades disposed in each of said first, second and third annular regions is different.

17. An apparatus for imparting a rotation to a volume of air entering a centrifugal blower rotatable about an axis of rotation, comprising:

a hub;

a plurality of stationary, airfoil-shaped blades disposed generally perpendicular to the axis of rotation of the centrifugal blower, each blade of said plurality of blades having a leading edge and a trailing edge and defining a transition portion therebetween;

a first annular ring having a predetermined diameter disposed around said hub and which defines a first annular region between said hub and said first annular ring and including a plurality of said blades, each blade being configured to rotate a volume of air approximately 65 degrees after said volume of air passes through said plurality of blades, said first annular region having the fewest number of blades;

a second annular ring having a predetermined diameter and disposed around said hub the diameter of said second annular ring being greater than the diameter of the first annular ring and which defines a second annular region between said hub and said second annular ring, said second annular region including a plurality of blades, each blade being configured to rotate a volume of air approximately 55 degrees after said volume of air passes through said plurality of blades, the blades in said second annular region having a different trailing edge profile than in said first annular region;

a third annular ring having a predetermined diameter and disposed around said hub, the diameter of said third annular ring being greater than the diameter of the second annular ring and which defines a third annular region between said hub and said third annular ring, said third annular region including a plurality of blades, each blade being configured to rotate a volume of air approximately 45 degrees after said volume of air passes through said plurality of blades, said third annular region having the greatest number of blades, the trailing edge profiles of said blades being configured differently than in said first or second annular regions;

whereby the rotation imparted upon the total volume of air exiting said apparatus and entering the centrifugal blower is approximately 45 degrees.

* * * * *